US011808109B1

(12) United States Patent
Conner et al.

(10) Patent No.: US 11,808,109 B1
(45) Date of Patent: Nov. 7, 2023

(54) FRANGIBLE DISK CONFIGURATION, METHOD AND SYSTEM

(71) Applicant: Baker Hughes Oilfield Operations LLC, Houston, TX (US)

(72) Inventors: Nicholas S. Conner, Cypress, TX (US); Edward J. Kossa, Huffman, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/077,682

(22) Filed: Dec. 8, 2022

(51) Int. Cl.
*E21B 34/06* (2006.01)

(52) U.S. Cl.
CPC ..... *E21B 34/063* (2013.01)

(58) Field of Classification Search
CPC ..... E21B 34/063
See application file for complete search history.

(56) References Cited

U.S. PATENT DOCUMENTS

| | | | | |
|---|---|---|---|---|
| 2,098,520 | A * | 11/1937 | Santiago | E21B 37/08 137/71 |
| 4,658,902 | A * | 4/1987 | Wesson | E21B 37/08 166/317 |
| RE39,209 | E * | 8/2006 | Barton | E21B 33/1295 166/324 |
| 8,813,848 | B2 * | 8/2014 | Frazier | E21B 34/063 166/376 |
| 10,107,070 | B2 * | 10/2018 | Yong | H04L 41/0266 |
| 11,149,522 | B2 * | 10/2021 | Brandsdal | E21B 34/063 |
| 11,346,171 | B2 * | 5/2022 | Yuan | E21B 23/0413 |
| 2020/0199980 | A1 * | 6/2020 | Campbell | E21B 34/142 |
| 2020/0256156 | A1 * | 8/2020 | Rosenthal | E21B 23/065 |

* cited by examiner

*Primary Examiner* — Aaron L Lembo
(74) *Attorney, Agent, or Firm* — CANTOR COLBURN LLP

(57) ABSTRACT

A frangible disk configuration including a housing, a sleeve in the housing, a releaser, releaseably retaining the sleeve in a fixed position relative to the housing and a frangible disk mounted in the housing in a position contactable by the sleeve after release by the releaser. A method for rupturing a frangible disk, including applying pressure to a configuration, causing release of the releaser at a threshold pressure on the applied pressure and sliding the sleeve into contact with the frangible disk. A borehole system including a borehole in a subsurface formation, and a frangible disk configuration, disposed in the borehole.

20 Claims, 3 Drawing Sheets

FRANGIBLE DISK CONFIGURATION, METHOD AND SYSTEM

BACKGROUND

In the resource recovery and fluid sequestration industries, rupture disks are often used to provide for a barrier that may be removed after the function thereof is not needed. Often rupture disks are ruptured simply be pressure acting thereon. Due to the need in some cases for high pressure containment before rupture, pressure related releases can also require exceptionally high pressures that require other changes in well construction and therefore additional cost. The art would well receive alternative configurations that retain value of the configuration while reducing ancillary difficulties and costs.

SUMMARY

An embodiment of a frangible disk configuration including a housing, a sleeve in the housing, a releaser, releaseably retaining the sleeve in a fixed position relative to the housing and a frangible disk mounted in the housing in a position contactable by the sleeve after release by the releaser.

An embodiment of a method for rupturing a frangible disk, including applying pressure to a configuration, causing release of the releaser at a threshold pressure on the applied pressure and sliding the sleeve into contact with the frangible disk.

An embodiment of a borehole system including a borehole in a subsurface formation, and a frangible disk configuration, disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
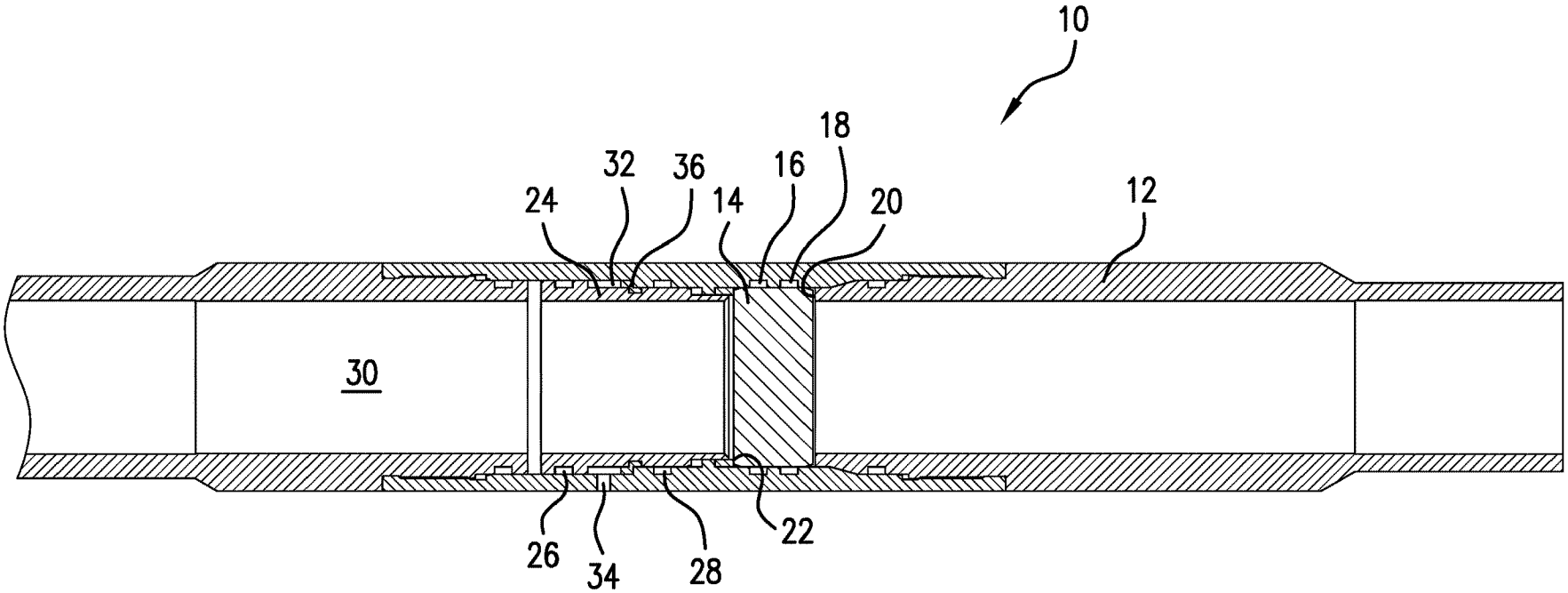
FIG. 1 is a section view of a frangible disk configuration as disclosed herein.
Figure 2:
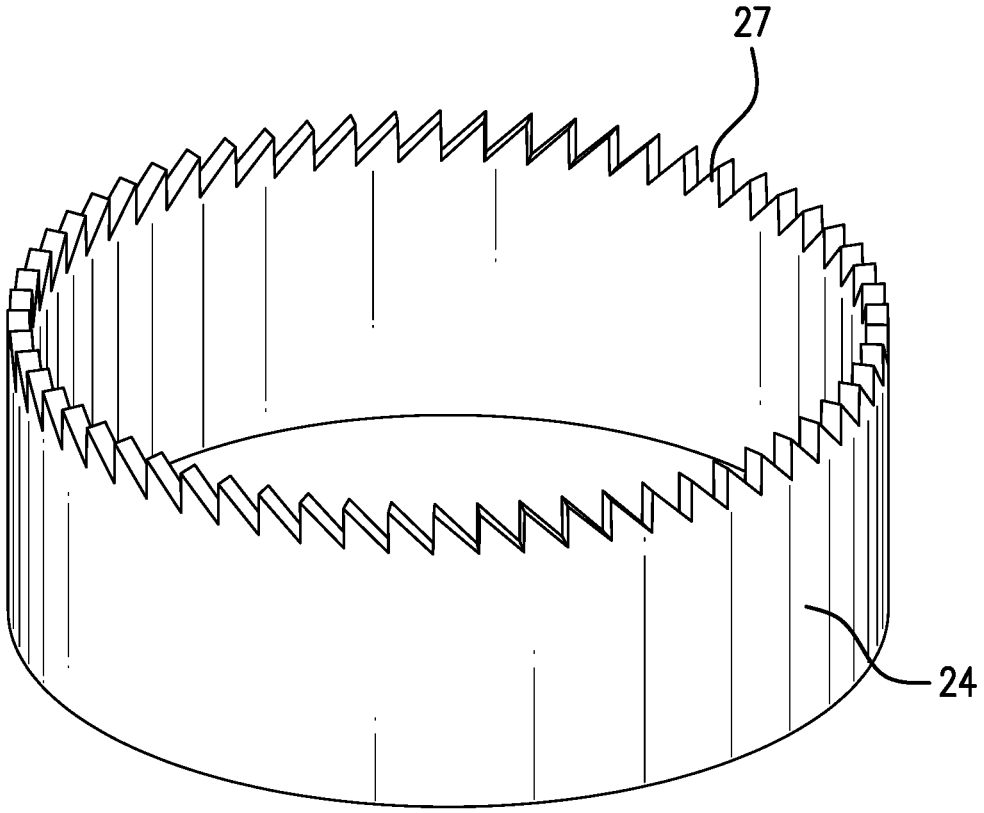
FIG. 2 is a perspective view of an embodiment of a featured sleeve.

Referring to FIG. 1, a frangible disk configuration 10 is illustrated. The configuration 10 includes a housing 12 that supports a frangible disk 14 to prevent movement thereof and to seal with the disk using seals 16 and 18. The disk 14 then prevents fluid or pressure from passing. Support for the disk 14 is provided by shoulder 20 of housing 12 and shoulder 22 that may be another part of housing 12 or may be a separate retainer such as a C ring. A sleeve 24 is mounted in the housing 12 and is slidable therein. The sleeve 24 includes a seal 26 and a seal 28 to separate fluid from an inside diameter (ID) 30 of the housing 12 from a chamber 32 that is defined between the sleeve 24 and the housing 12. The chamber 32 may, in an embodiment, be an atmospheric chamber or may be at a pressure that is not atmospheric but is less than ambient pressure in the location in which the configuration is ultimately to be used. The chamber 32 provides for differential pressure across seals 26 and 28 from a pressure increase in the ID 30. Alternatively, there may be a port 34 in the housing 12 that connects the chamber 32 to a space outside of the housing 12, such as an *annuus* of a borehole when the configuration 10 is in use. The chamber 32, whether configured as a lower pressure chamber or configured with port 34 allows the sleeve 24, when responding to pressure increase in the ID 30, to slide toward the disk 14, ultimately making contact therewith and rupturing the same. Preventing the sliding action is a releaser 36 that initially retains the sleeve 24 in a fixed position relative to the housing 12. The initial position of the sleeve 24 is retained until the releaser 36 is released. In each case, the releaser 36 is releasable responsively to a differential in pressure across the sleeve that exceeds a threshold for release of the releaser 36, i.e. a differential in pressure that creates a load on the releaser 36 that is greater than the structural ability of the releaser 36 to hold. The particular threshold is one that is selected when configuring the releaser 36, during manufacture.

The releaser 36 may be a shear ring that is separate from the housing 12 and the sleeve 24 and is interposed in a position where it can prevent relative movement therebetween until the threshold is reached, or it can be a part of the sleeve 24 or a part of the housing 12. The releaser 36 in another embodiment could be a collet that is one of interposed between the housing 12 and sleeve 24, or a part of one or the other of the housing 12 or sleeve 24. Other release configurations are also contemplated.

During use, it will be appreciated that the pressure differential will build over a period of time that, although small is still a period of time. The threshold for release of releaser 36 effectively stored that energy and then upon release of releaser 36 suddenly discharges that energy into the disk 14 by virtue of the sleeve 24 suddenly moving to impact the disk 14. Impacts are somewhat more effective in rupturing a rupture disk and so the configuration benefits from that function. It will be appreciated however, that disk 14 may also be ruptured without the impact but rather simply from contact pressure through the sleeve 24.

In embodiments, the sleeve 24 may be configured with a fully circumferential edge 25 that will at the appropriate time contact the rupture disk as can be appreciated from FIG. 1. In other embodiments, the sleeve 24 may have one or more load features 27 that will contact the disk 14 preferentially thereby increasing point load thereon. The feature(s) may comprise notches, serrations, castellations, etc. Essentially the features reduce the contact area of the sleeve 24 with the disk 14 to increase contact pressure with the disk 14 at the reduced contact area based upon the same input force from the sleeve.

Figure 3:
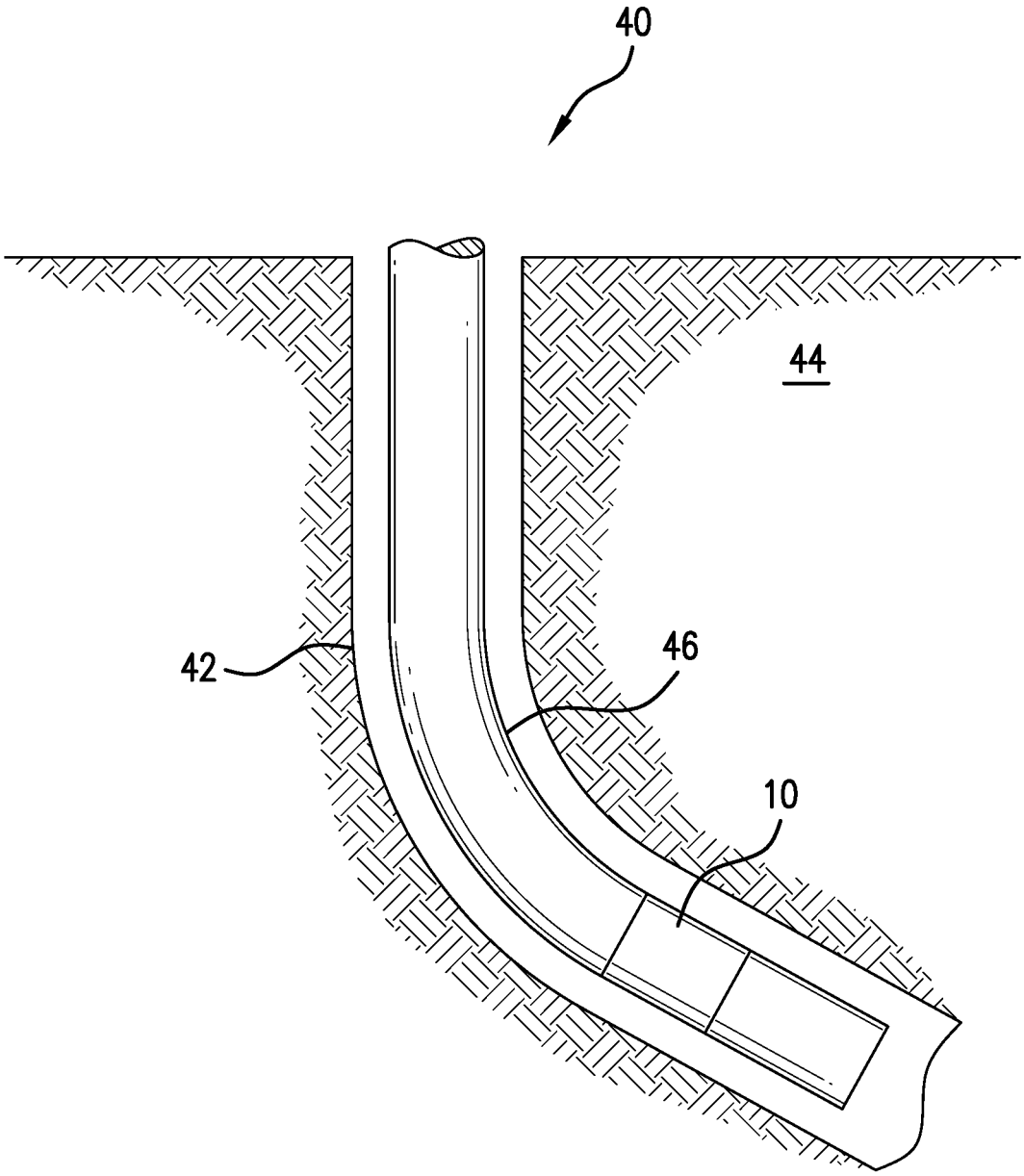
FIG. 3 is a borehole system including the configuration disclosed herein.

Referring to FIG. 3, a borehole system 40 is illustrated. The system 40 comprises a borehole 42 in a subsurface formation 44. A string 46 is disposed within the borehole 42. A frangible disk configuration 10 is disposed within or as a part of the string 46.

Set forth below are some embodiments of the foregoing disclosure:

Embodiment 1: A frangible disk configuration including a housing, a sleeve in the housing, a releaser, releaseably retaining the sleeve in a fixed position relative to the housing and a frangible disk mounted in the housing in a position contactable by the sleeve after release by the releaser.

Embodiment 2: The configuration as in any prior embodiment, wherein the sleeve is slidably sealed to the housing.

Embodiment 3: The configuration as in any prior embodiment, wherein the sleeve includes a load feature.

Embodiment 4: The configuration as in any prior embodiment, wherein the releaser is a shear ring.

Embodiment 5: The configuration as in any prior embodiment, wherein the ring is circumferentially discontinuous.

Embodiment 6: The configuration as in any prior embodiment, wherein the ring is circumferentially continuous.

Embodiment 7: The configuration as in any prior embodiment, wherein the ring is separate from the housing and the sleeve.

Embodiment 8: The configuration as in any prior embodiment, wherein the ring is a part of the housing or the sleeve.

Embodiment 9: The configuration as in any prior embodiment, wherein the releaser is a collet.

Embodiment 10: The configuration as in any prior embodiment, wherein the sleeve is disposed in the housing in a position that is upstream of the frangible disk when the configuration is in use.

Embodiment 11: The configuration as in any prior embodiment, further including an atmospheric chamber defined between the housing and the sleeve.

Embodiment 12: The configuration as in any prior embodiment, further including a port through the housing from a chamber defined between the sleeve and the housing and a space outside of the housing.

Embodiment 13: The configuration as in any prior embodiment, wherein the space is an annulus of a borehole.

Embodiment 14: A method for rupturing a frangible disk, including applying pressure to a configuration as in any prior embodiment, causing release of the releaser at a threshold pressure on the applied pressure and sliding the sleeve into contact with the frangible disk.

Embodiment 15: The method as in any prior embodiment, wherein the sliding includes causing an impact force between the sleeve and the frangible disk.

Embodiment 16: The method as in any prior embodiment, wherein the causing release is shearing.

Embodiment 17: The method as in any prior embodiment, wherein the causing release is disengaging.

Embodiment 18: A borehole system including a borehole in a subsurface formation, and a frangible disk configuration as in any prior embodiment, disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frangible disk configuration comprising:

a housing;

a sleeve in the housing;

a releaser, releaseably retaining the sleeve in a fixed position relative to the housing; and a frangible disk mounted in the housing in a position contactable, without impact, by the sleeve after release by the releaser, the sleeve exerting a contact pressure on the frangible disk to rupture the frangible disk, during use.

2. The configuration as claimed in claim 1, wherein the sleeve is slidably sealed to the housing.

3. The configuration as claimed in claim 1, wherein the sleeve includes a load feature.

4. The configuration as claimed in claim 3, wherein the load feature is a plurality of notches.

5. The configuration as claimed in claim 3, wherein the load feature is a plurality of serrations.

6. The configuration as claimed in claim 1, wherein the releaser is a shear ring.

7. The configuration as claimed in claim 6, wherein the ring is circumferentially discontinuous.

8. The configuration as claimed in claim 6, wherein the ring is circumferentially continuous.

9. The configuration as claimed in claim 6, wherein the ring is separate from the housing and the sleeve.

10. The configuration as claimed in claim 6, wherein the ring is a part of the housing or the sleeve.

11. The configuration as claimed in claim 1, wherein the releaser is a collet.

12. The configuration as claimed in claim 1, wherein the sleeve is disposed in the housing in a position that is upstream of the frangible disk when the configuration is in use.

13. The configuration as claimed in claim 1, further including an atmospheric chamber defined between the housing and the sleeve.

14. The configuration as claimed in claim 1, further including a port through the housing from a chamber defined between the sleeve and the housing and a space outside of the housing.

15. The configuration as claimed in claim 14, wherein the space is an annulus of a borehole.

16. A method for rupturing a frangible disk, comprising:

applying pressure to a configuration as claimed in claim 1;

causing release of the releaser at a threshold pressure on the applied pressure; and sliding the sleeve into contact with the frangible disk, without impact.

17. The method as claimed in claim 16, wherein the sliding includes causing an impact force between the sleeve and the frangible disk.

18. The method as claimed in claim 16, wherein the causing release is shearing.

19. The method as claimed in claim 16, wherein the causing release is disengaging.

20. A borehole system comprising:

a borehole in a subsurface formation; and a frangible disk configuration as claimed in claim 1, disposed in the borehole.

* * * * *